US008453856B2

(12) United States Patent
Skelton et al.

(10) Patent No.: US 8,453,856 B2
(45) Date of Patent: Jun. 4, 2013

(54) TAMPER-EVIDENT CLOSURE

(75) Inventors: Steven Andrew Skelton, Clackmannanshire (GB); Alexander Donald Meiklem McPherson, Falkirk (GB); James Harrower, Sterling (GB)

(73) Assignee: Obrist Closures Switzerland GmbH, Reinach (CH)

( * ) Notice: Subject to any disclaimer, the term of this patent is extended or adjusted under 35 U.S.C. 154(b) by 515 days.

(21) Appl. No.: 12/666,630

(22) PCT Filed: Jul. 10, 2008

(86) PCT No.: PCT/GB2008/002343

§ 371 (c)(1),
(2), (4) Date: Mar. 5, 2010

(87) PCT Pub. No.: WO2009/010717

PCT Pub. Date: Jan. 22, 2009

(65) Prior Publication Data

US 2010/0170898 A1 Jul. 8, 2010

(30) Foreign Application Priority Data

Jul. 13, 2007 (GB) ..... 0713712.8

(51) Int. Cl.
*B65D 41/34* (2006.01)

(52) U.S. Cl.
USPC ..... 215/230; 215/252

(58) Field of Classification Search
USPC ..... 215/21, 44, 329, 330, 331, 252, 277, 215/230; 220/259.3, 259.4; 222/81, 83
See application file for complete search history.

(56) References Cited

U.S. PATENT DOCUMENTS

| | | | |
|---|---|---|---|
| 1,798,151 | A | 3/1931 | Fabrice |
| 2,858,054 | A | 10/1958 | Harkrader |
| 3,348,718 | A | 10/1967 | Musy |
| 3,412,890 | A | 11/1968 | Rich |
| 3,425,578 | A | 2/1969 | Owens |
| 3,455,479 | A | 7/1969 | Wilton |

(Continued)

FOREIGN PATENT DOCUMENTS

| | | |
|---|---|---|
| DE | 809 896 | 8/1951 |
| DE | 861 666 | 1/1953 |

(Continued)

OTHER PUBLICATIONS

Assignment Data for U.S. Appl. No. 12/666,630.*

(Continued)

*Primary Examiner* — Anthony Stashick
*Assistant Examiner* — James N Smalley
(74) *Attorney, Agent, or Firm* — Andrew F. Young, Esq.; Lackenbach Siegel, LLP

(57) ABSTRACT

A tamper evident closure for a container is provided. The closure comprises a first portion including inner and outer parts, and a second portion. The outer part is movable relative to the inner part from a first position in which at least part of the first and second portions are adjacent each other to a second position in which there is a gap therebetween. The closure comprises locking means for locking it in the second position upon first opening so that the gap cannot easily be closed. The closure further comprises indicator means for providing a visual indication if the locking means is overridden to close the gap.

21 Claims, 20 Drawing Sheets

U.S. PATENT DOCUMENTS

| | | | |
|---|---|---|---|
| 3,603,470 | A | 9/1971 | Armour |
| 3,810,556 | A | 5/1974 | Coursaut |
| 3,820,683 | A | 6/1974 | Jasinski |
| 3,871,545 | A | 3/1975 | Bereziat |
| 3,892,351 | A | 7/1975 | Johnson et al. |
| 4,091,949 | A | 5/1978 | Fowles et al. |
| 4,303,171 | A | 12/1981 | Schremmer |
| 4,310,105 | A | 1/1982 | Gach |
| 4,531,649 | A | 7/1985 | Shull |
| 4,569,464 | A | 2/1986 | Wassilieff |
| 4,637,519 | A | 1/1987 | Dutt et al. |
| 4,697,719 | A | 10/1987 | Allen |
| 4,744,480 | A | 5/1988 | Luch et al. |
| 4,790,442 | A | 12/1988 | Gach |
| 4,838,441 | A | 6/1989 | Chernack |
| 4,941,592 | A | 7/1990 | Kitterman |
| 4,942,970 | A | 7/1990 | Jay |
| 5,004,126 | A | 4/1991 | Klesius |
| 5,332,113 | A | 7/1994 | Kusler et al. |
| 5,427,260 | A | 6/1995 | Mueller et al. |
| 5,445,824 | A | 8/1995 | Someya |
| 5,588,545 | A | 12/1996 | King et al. |
| 5,603,422 | A | 2/1997 | Herrmann |
| 5,683,016 | A | 11/1997 | Santagiuliana |
| 5,819,965 | A | 10/1998 | King et al. |
| 6,036,036 | A | 3/2000 | Bilani et al. |
| 6,095,375 | A | 8/2000 | Adams et al. |
| 6,269,986 | B1 | 8/2001 | Gross |
| 6,484,879 | B2 | 11/2002 | Desmarais et al. |
| 6,683,038 | B2 | 1/2004 | Forth et al. |
| 6,685,046 | B2 | 2/2004 | Ogino |
| 6,688,501 | B2 | 2/2004 | DeGroot et al. |
| 6,727,215 | B2 | 4/2004 | Roberts et al. |
| 6,866,164 | B2 | 3/2005 | Branson et al. |
| 6,880,729 | B2 | 4/2005 | Stull et al. |
| 6,908,013 | B2 | 6/2005 | Thomson et al. |
| 7,073,679 | B1 | 7/2006 | Lagler et al. |
| 7,121,419 | B2 | 10/2006 | Ferry et al. |
| 7,125,828 | B2 | 10/2006 | Catlin et al. |
| 7,204,383 | B2 | 4/2007 | Hsu |
| 2002/0125249 | A1 | 9/2002 | Baird-Smith et al. |
| 2004/0026420 | A1 | 2/2004 | Smith |
| 2004/0143505 | A1 | 7/2004 | Kovach |
| 2005/0133475 | A1 | 6/2005 | Goto et al. |
| 2005/0205607 | A1 | 9/2005 | Hierzer et al. |
| 2006/0011573 | A1 | 1/2006 | Herald et al. |
| 2006/0043052 | A1 | 3/2006 | Lin |
| 2006/0077062 | A1 | 4/2006 | Andrechak et al. |
| 2006/0770621 | | 4/2006 | Andrechak |
| 2006/0124646 | A1 | 6/2006 | Gugliemini et al. |
| 2008/0190880 | A1 | 8/2008 | Needham |
| 2008/0277613 | A1 | 11/2008 | Ramsey et al. |
| 2009/0173007 | A1 | 7/2009 | Fogg |
| 2010/0170898 | A1 | 7/2010 | Skelton et al. |

FOREIGN PATENT DOCUMENTS

| | | | |
|---|---|---|---|
| DE | 85 35 205 | U | 2/1986 |
| DE | 3 605 963 | | 8/1987 |
| DE | 200 19 797 | U1 | 5/2001 |
| EP | 0 127 943 | A1 | 12/1984 |
| EP | 0 132 792 | A1 | 2/1985 |
| EP | 0 179 498 | A1 | 4/1986 |
| EP | 0 236 136 | A2 | 9/1987 |
| EP | 0 306 670 | A2 | 3/1989 |
| EP | 0 337 568 | A2 | 10/1989 |
| EP | 0 414 462 | A2 | 2/1991 |
| EP | 0 593 952 | A1 | 9/1993 |
| EP | 0 619 243 | A1 | 10/1994 |
| EP | 0 688 723 | A1 | 12/1995 |
| EP | 1 101 707 | A1 | 5/2001 |
| EP | 1 266 839 | A | 12/2002 |
| EP | 1 266 839 | A2 | 12/2002 |
| EP | 1 283 175 | A2 | 2/2003 |
| EP | 1 161 382 | B1 | 9/2003 |
| EP | 2005/053085 | | 6/2004 |
| EP | 1 392 575 | B1 | 9/2005 |
| EP | 1 694 576 | B1 | 2/2008 |
| EP | 1 786 698 | B1 | 9/2008 |
| EP | 1 663 809 | B1 | 10/2008 |
| EP | 1 981 774 | B1 | 9/2009 |
| FR | 2 439 139 | A | 5/1980 |
| FR | 2 567 106 | A | 1/1986 |
| FR | 2 591 571 | A | 6/1987 |
| GB | 1 298 084 | A | 11/1972 |
| GB | 1 473 482 | | 5/1977 |
| GB | 1484517 | | 9/1977 |
| GB | 2 123 392 | A | 2/1984 |
| GB | 2 136 782 | A | 9/1984 |
| GB | 2 148 235 | A | 5/1985 |
| GB | 2 158 424 | A | 11/1985 |
| GB | 2 172 803 | A | 10/1986 |
| GB | 2 222 821 | | 3/1990 |
| GB | 2 264 110 | B | 8/1993 |
| GB | 2 311 283 | A | 9/1997 |
| GB | 2 355 269 | A | 4/2001 |
| GB | 2 356 842 | A | 6/2001 |
| GB | 2 375 516 | A | 11/2002 |
| GB | 2 430 667 | A | 4/2007 |
| GB | 2 415 426 | | 5/2007 |
| GB | 2 432 153 | | 11/2007 |
| JP | 10 338251 | A | 3/1999 |
| JP | 2000/229651 | | 8/2000 |
| JP | 2003160162 | A | 11/2001 |
| WO | WO 94/07470 | A1 | 4/1994 |
| WO | WO 99/57031 | A1 | 11/1999 |
| WO | WO 00/26878 | A1 | 5/2000 |
| WO | WO 00/66451 | A1 | 11/2000 |
| WO | WO 01/36290 | A1 | 5/2001 |
| WO | WO 01/83668 | A1 | 11/2001 |
| WO | WO 02/44047 | A1 | 6/2002 |
| WO | WO 02/085730 | | 10/2002 |
| WO | WO 02/096771 | A1 | 12/2002 |
| WO | WO 03/016162 | A1 | 2/2003 |
| WO | WO 03/016165 | A1 | 2/2003 |
| WO | WO 2004/011347 | | 2/2004 |
| WO | WO 2005/024745 | A2 | 3/2005 |
| WO | WO 2005/049443 | | 6/2005 |
| WO | WO 2005/072941 | | 8/2005 |
| WO | WO 2006/000532 | A1 | 1/2006 |
| WO | WO 2006/003168 | | 1/2006 |
| WO | WO 2006/008285 | | 1/2006 |
| WO | WO 2006/020059 | A2 | 2/2006 |
| WO | WO 2006/117505 | | 11/2006 |
| WO | WO2006/117505 | A1 | 11/2006 |
| WO | WO 2007/125292 | A2 | 11/2007 |
| WO | WO 2008/110917 | | 9/2008 |
| WO | WO 2009/056829 | A1 | 5/2009 |

OTHER PUBLICATIONS

European Appln. No. 08 775.887.6—Examination Report dated Nov. 16, 2010, 5 pages.

Serial No. PCTGB2008/002343 filed Jul. 10, 2008, International Search Report and Written Opinion of the International Searching Authority, 12 pages.

Serial No. GB 0713712.8, Search Report, 2 pages.

International Search Report dated Feb. 27, 2008; UK Application No. GB 0721330.9; 4 pages.

Serial No. PCT/EP2005/053441, completed Dec. 1, 2005, International Search Report and Written Opinion of the International Searching Authority, 5 pages.

Serial No. PCT/EP2003/07798, mailed Oct. 15, 2004, International Search Report and Written Opinion of the International Searching Authority, 5 pages.

EP 1 663 809 B1 Documents related to EP Opposition (EP Patent Granted)—8 pages.

U.S. Appl. No. 10/577,575, filed Sep. 5, 2006, Skelton.

U.S. Appl. No. 12/664,961, filed Dec. 16, 2009, Skelton.

U.S. Appl. No. 12/666,630, filed Mar. 5, 2010, Skelton.

* cited by examiner

TAMPER-EVIDENT CLOSURE

CROSS REFERENCE TO RELATED APPLICATIONS

This application claims priority from PCT Patent Application Serial No. PCT/GB2008/002343, filed Jul. 10, 2008, the entire contents of which are herein incorporated by reference, which in turn claims priority from Great Britain Patent Application Serial No. 0713712.8 filed Jul. 13, 2007.

BACKGROUND OF THE INVENTION

1. Field of the Invention

The present invention relates generally to a closure for a container and particularly to a closure with means for indicating that a closure has been opened at least once.

2. Description of the Related Art

There is an increasing demand for tamper-indicating systems which ensure that a container is not re-filled with non-original contents. While it is relatively easy to produce some form of tamper-evidence, it is much more difficult to provide tamper-evidence which cannot be either overcome without causing the tamper-evidence system to activate, or activate and then return to a virtually visually identical state so as to appear non-activated.

A particularly useful method of providing tamper-evidence is to use a system in which a closure is initially located in a first position, but once removed can only be returned to a second position which is visually distinct from the first.

U.S. Pat. No. 5,738,231 describes a closure with a part which is moved during the opening process so that following opening it cannot pass back over projection on a container finish. The result is that the closure can only return to position which is axially displaced with respect to its original position.

WO 02/096771 describes a closure in which two parts are initially adjacent each other and during the opening process the structure of the closure is changed so that a gap is generated between the two parts as a visual indication that the closure has been opened at least once.

WO 2005/049443 and WO 2006/117505 also describe closures which generate a gap to indicate they have been opened at least once. In this case the gap is unobstructed. In other words, two parts of the closure are held apart without the requirement an obstruction.

What is not appreciated by the prior art is that such tamper-evident systems are only effective if they cannot be reversed. For example, in systems which use an obstructing member to hold two parts apart it is possible to cut the obstruction member to allow a gap to be closed. WO 2005/049443 and WO 2006/117505 describe closures which generate unobstructed gaps following relative rotation of one part with respect to another. The closures are provided with some internal mechanism for preventing the two parts from being rotated back to their original relative positions. For example, ratchet arrangements present on the side walls of the parts can be used to prevent unwanted rotation. Such "lateral" ratchet arrangements have been found to be defeatable if sufficient reverse turning torque is applied. Furthermore, it has been found that under some circumstances if significant axial force is applied to the closure the gap can be closed.

Accordingly, there is a need for an improved level of resistance to re-setting gap-generating closures to reduce the risk that the gap can be re-closed after a first opening.

ASPECTS AND SUMMARY OF THE INVENTION

An aspect of the present invention is to provide an increased level of resistance to re-setting such gap-generating closures to reduce the risk that the gap can be re-closed after a first opening.

According to the present invention there is provided a tamper-evident closure for a container, which comprises a first portion further comprising inner and outer parts, and a second portion. The outer part is movable relative to the inner part from a first position in which at least part of the first and second portions are adjacent each other to a second position in which there is a gap therebetween. The closure comprises locking means for locking the closure in the second position upon first opening so that the gap cannot easily be closed. The closure further comprises indicator means for providing a visual indication if the locking means is overridden to close the gap.

The indicator means may be adapted to activate following axial overriding of the locking means to close the gap. For example, if sufficient force is applied to the top of the closure the locking means may be overridden (possibly by breaking) and the inner and outer parts may be returned to the first position to close the gap by relative axial movement. In this case the indicator means are activated to show that, even though the gap is not present, the closure has been opened.

The indicator means may be adapted to activate following rotational overriding of the locking means to close the gap. For example, if sufficient reverse turning force is applied to the closure the locking means may be overridden (possibly by breaking it) and the inner and outer parts may be returned to the first position to close the gap by relative axial movement. In this case the indicator means are activated to show that, even though the gap is not present, the closure has been opened.

The closure may further comprise a shell, such as a metal shell, which covers the working components. The gap may be formed within the shell. The indicator means may be adapted to mark the shell to indicate closing of the gap.

The indicator means may be adapted to produce one or more markings on the surface of the closure to indicate closing of the gap. The marking may comprise, for example, surface deformations in the form of bulges, or partial or complete destruction or alteration of an existing formation.

The indicator means may be adapted to puncture the surface of the closure to indicate closing of the gap. The indicator means may also form part of the locking means. The locking means may be adapted to prevent relative rotation between the inner and outer parts.

The outer part may include a top plate and part of the locking means is carried on or by the plate. The inner part may include a top plate. Part of the locking means may be carried on or by the plate. The locking means may comprise or include a ratchet arrangement.

In one embodiment, both the inner and outer parts have respective top plates which include corresponding ratchet parts that engage to prevent relative rotation of the parts. This type of ratchet arrangement may be referred to as a longitudinal ratchet arrangement, as opposed to known lateral arrangements which are positioned on side walls.

The second portion may be adapted to be connected to a container and the first portion may comprise a cap. Certain industries demand closures with a first portion comprising a cap and a second portion comprising a sleeve which is connected to a container; for example the spirits industry.

The closure may further comprise an in-bore fitment. Alternatively the first portion may be adapted to engage an in-bore fitment associated with the container. Certain industries, in particular the spirits industry, demand additional measures to prevent tampering. In-bore fitments, such as non-return fitments, are often fitted to containers to prevent re-filling regardless of other tamper-proofing measures.

The closure may include means for preventing the inner part from moving relative to the second portion until it has reached the second position.

The gap may be unobstructed. This means that the closure would not have to rely on an obstructing member becoming trapped. By forming an unobstructed gap it is not possible to defeat the tamper-evidence by a simple cutting operation. The gap may be formed at the respective adjacent peripheries of the portions. The inner part may include a section which extends beyond the outer part towards the second portion in the second position; the part may be positioned so as to be visible through the gap.

The second portion may be permanently fixed in its position on the container. This can be used to prevent the second portion from being moved to close the gap.

The first portion may further include a lateral ratchet arrangement for locking the inner and outer parts in the second position. This provides increased resistance to re-setting.

The first portion may include engagement formations and the lateral ratchet arrangement is located above the formations. The first portion may include formations, such as screw threads, for engaging the container or in-bore fitment. In such cases the ratchet arrangement or other locking mechanism may be located above the formations so as to increase the difficulty in accessing and tampering with the locking arrangement.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
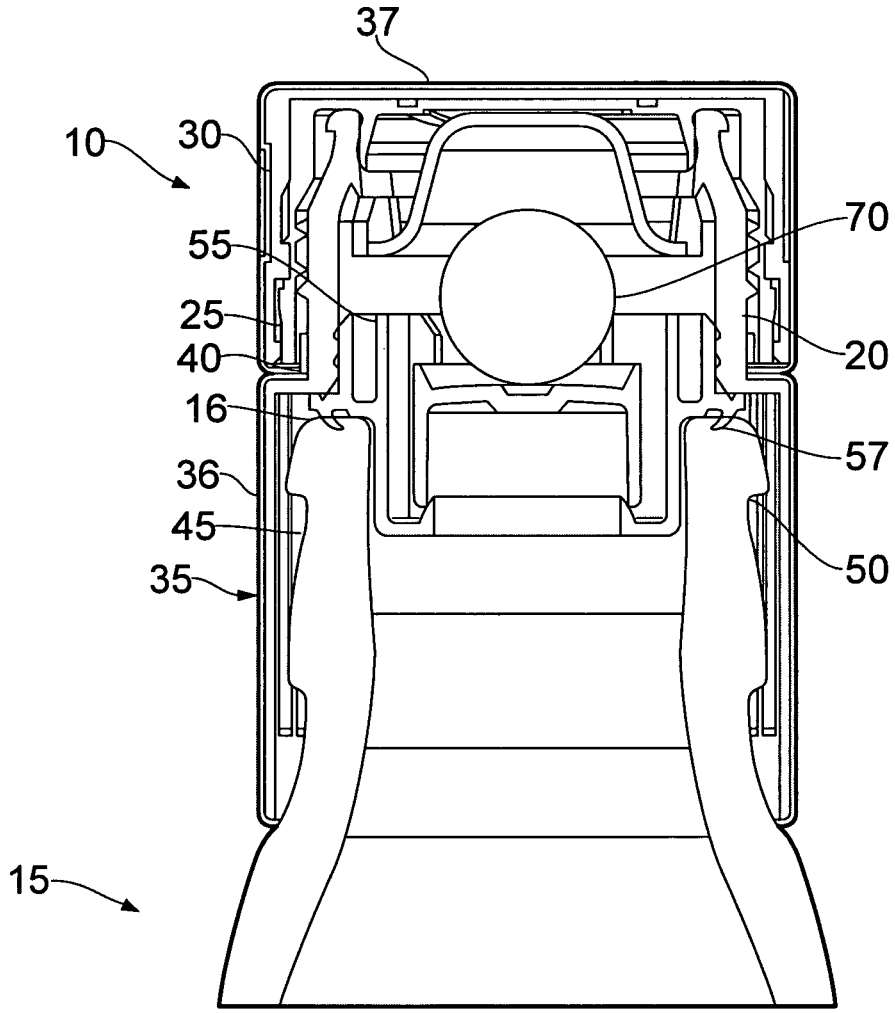
FIG. 1 is a section of a closure formed according to the present invention in a first, unopened position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring first to FIG. 1, there is shown a closure generally indicated 10 secured onto a container neck 15.

The closure 10 comprises a main body 20, an inner part 25 and an outer part 30. A metal shell 35 forms an outer casing to the closure and is divided into a cylindrical lower part 36 and a cup-shape second part 37. The parts 36, 37 are separated at a split line 40 formed by a cutting process once the shell 35 has been applied to the first and second portions of the closure. Together, the body 20 and the shell part 36 comprise a second portion and the inner and outer parts plus the shell part 37 comprises a cap-like first portion.

The main body 20 is fixed onto the container neck 15 by clips 45 which project inwardly and engage under a shoulder 50. A valve housing 55 is clipped into the main body 20 and includes a sealing lip 57 which seals against the top surface 16 of the container neck 15.

A float valve 65 is housed in the housing 55 and can seal against a valve seat 60 to prevent re-filling of the container. A valve control ball 70 is located on top of the float valve 65.

In use, the second part 37 of the shell 35 is rotated. This unscrews the outer part 30 from the inner part 25. The outer part unscrews until a locking mechanism described in more detail below locks it to the inner part 25. With the outer and inner parts locked together the inner part 25 can then be unscrewed from the main body 20.

When the cap (shell part 37/outer part 30/inner part 25) is screwed back onto the main body 20, a gap G is formed between the first and second shell parts 36, 37. This is because the outer part 30 cannot be screwed completely back down onto the inner part 25 by virtue of the locking mechanism. In addition, the bottom of the inner part 25 protrudes below the bottom of the outer part 30 so as to be visible in the gap G.

The gap G formed between the shell parts 36, 37 is unobstructed in the sense that there is no obstruction member trapped between the parts 36, 37.

Figure 4A:
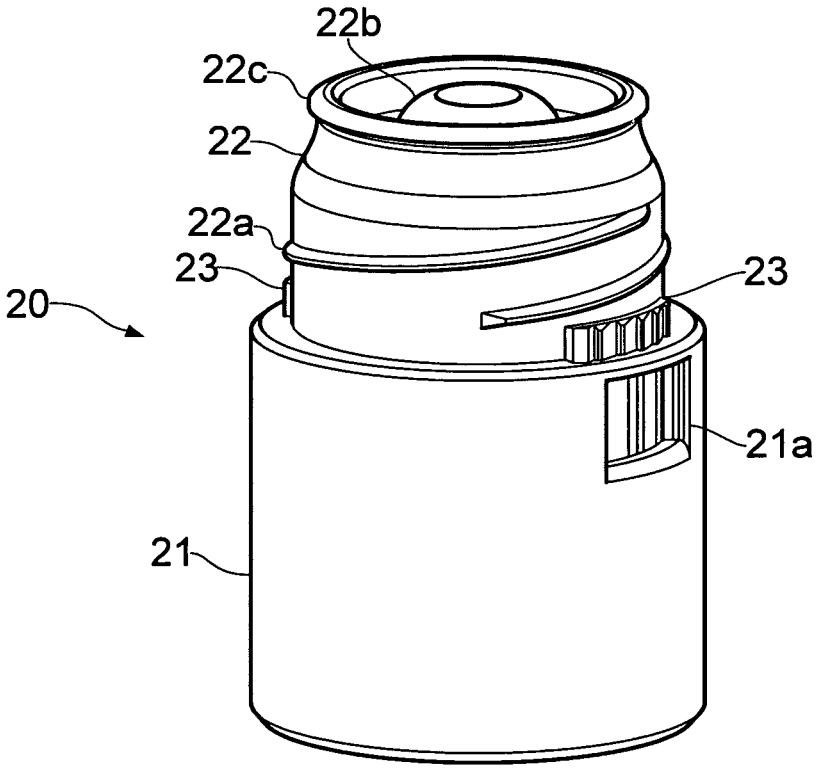
FIG. 4A is a perspective view of a second portion of the closure.
Figure 4B:
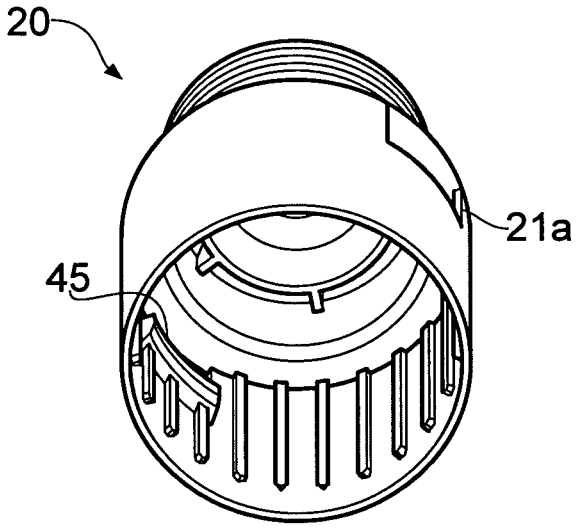
FIG. 4B is an underside perspective view of the second portion shown in FIG. 4A.

Referring now to FIGS. 4A and 4B the main body 20 is shown in more detail.

Figure 2:
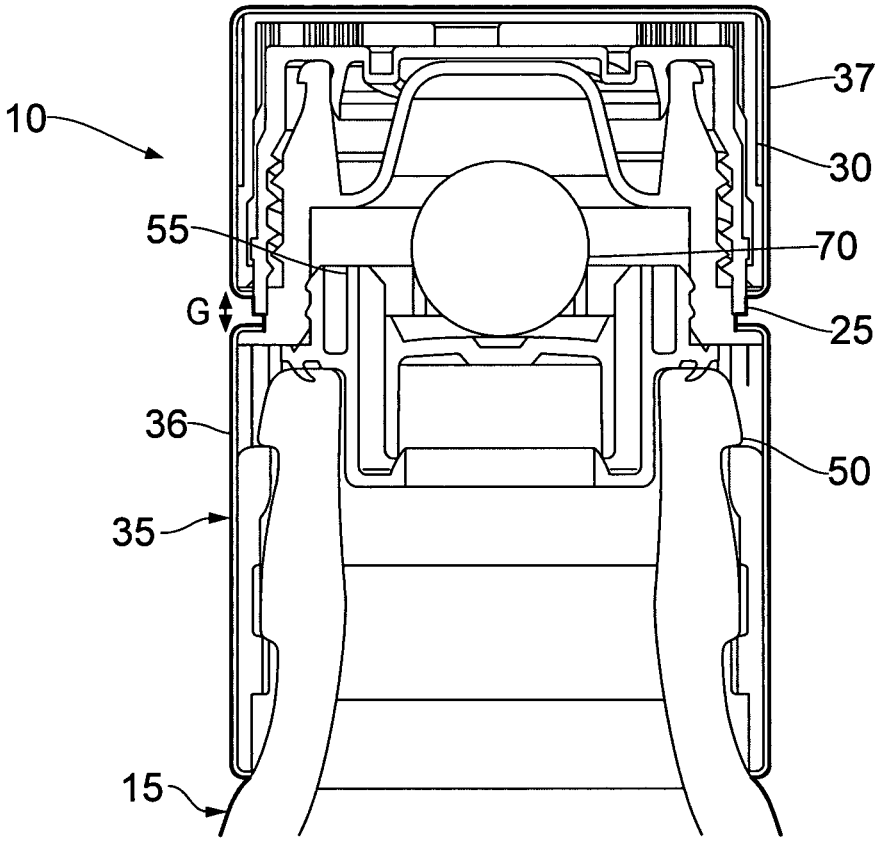
FIG. 2 is a section of the closure of FIG. 1 shown in a second, opened position.
Figure 3:
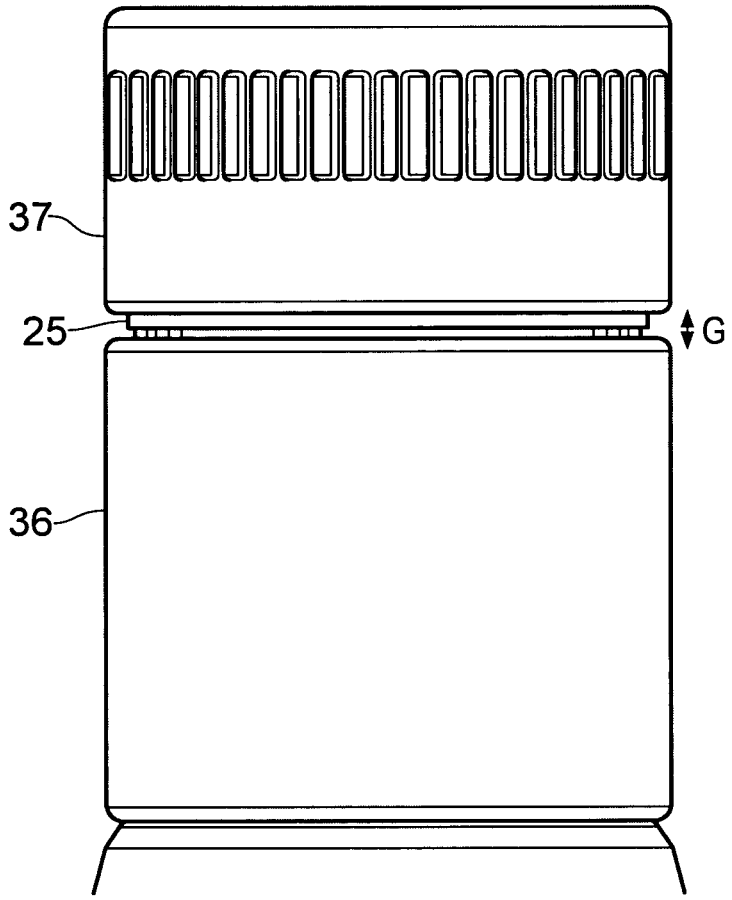
FIG. 3 is a side elevation of the opened closure shown in FIG. 2.

The body 20 comprises a lower engagement portion 21 and an upper flow regulation portion 22. The lower portion 21 comprises a generally cylindrical body having two diametrically opposed windows 21*a* each of which has at a lower edge a ledge 45 for engagement under the container neck shoulder 50 as shown in FIGS. 1 and 2. In addition, the interior surface of the lower portion 21*a* has a plurality of mutually spaced axial ribs 21*b* which lock onto the outer surface of the container neck in use to prevent relative rotation between the container neck and the body 20.

The upper portion 22 of the main body 20 is generally frusto-conical in shape and has external screw threads 22*a*. At the base of the portion 22 where it joins the portion 21, two sets of ratchet teeth 23 are positioned. The teeth 23 engage corresponding teeth on the inner part 25 to prevent it from rotating whilst the outer part 30 is being rotated for the first time in use. Only after the outer part 30 has locked against the inner part 25 can the inner part 25 be rotated relative to the body 20. At the opposite end of the portion 22 a dome-shape flow regulator 22*b* is positioned in the aperture. The aperture itself is defined by a circumferential pouring lip 22*c*.

Figure 5A:
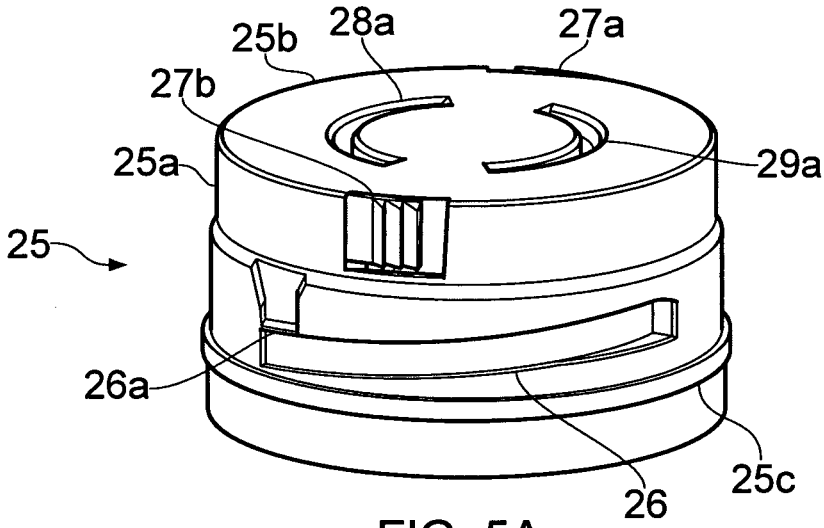
FIG. 5A is a perspective view of a first portion inner part of the closure.
Figure 5B:
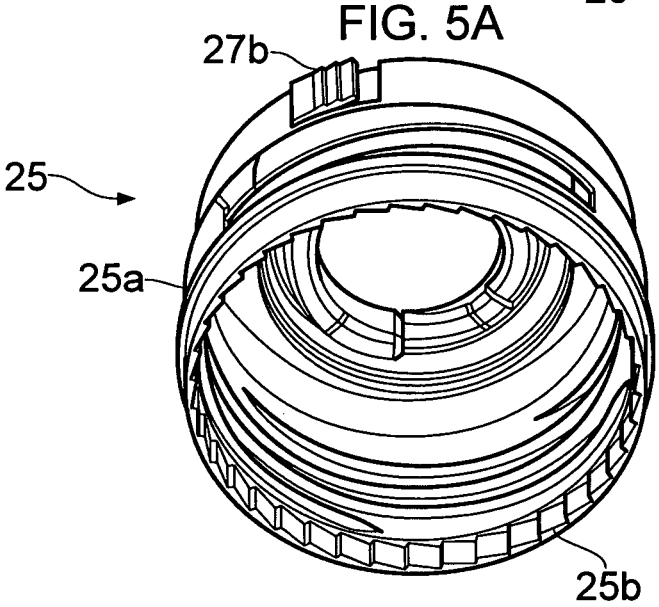
FIG. 5B is an underside perspective view of the inner part of FIG. 5A.
Figure 5C:
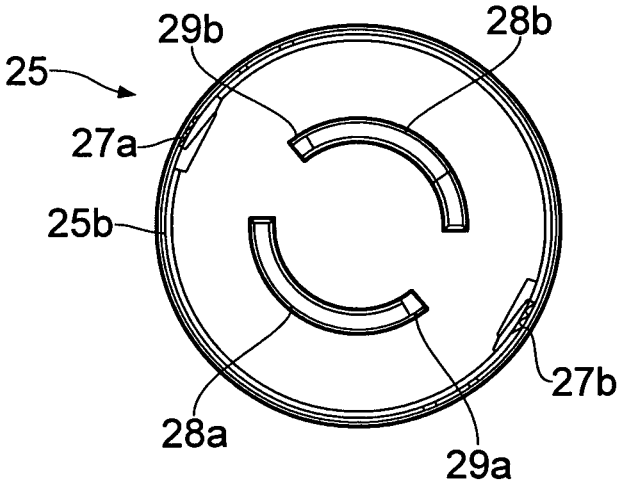
FIG. 5C is a plan view of the inner part shown in FIG. 5A.

Referring now to FIGS. 5A to 5C the inner part 25 is shown in more detail.

The inner part 25 is generally cup-shape with a cylindrical side wall 25*a* closed at one end by a top plate 25*b*. The interior surface of the open end of the sidewall 25*a* includes a continuous series of ratchet teeth 25*b* which engage the ratchets 23 on the main body portion 22.

The exterior of the sidewall 25*a* includes two inclined side ramps 26. At the start of each ramp 26 is a locking step 26*a* the purpose of which will be described in more detail below.

The sidewall 25*a* also comprises a pair of ratchet members 27*a*, 27*b* adjacent the top plate 25*b*. The exterior surface of the sidewall 25*a* also comprises a circumferential bead 25*c* the purpose of which will be described in more detail below. The top plate 25*b* comprises a pair of opposing arcuate ramps 28*a*, 28*b* each of which terminates with a locking recess 29*a*, 29*b*.

Figure 6A:
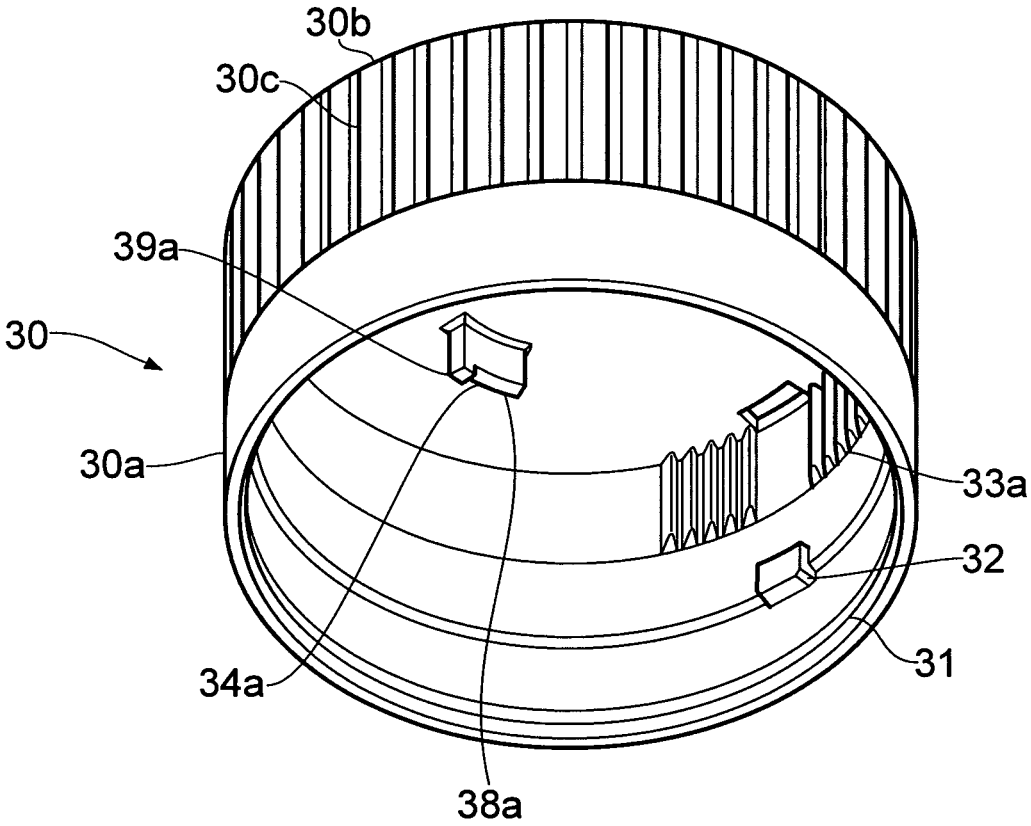
FIG. 6A is an underside perspective view of a first portion outer part of the closure.
Figure 6B:
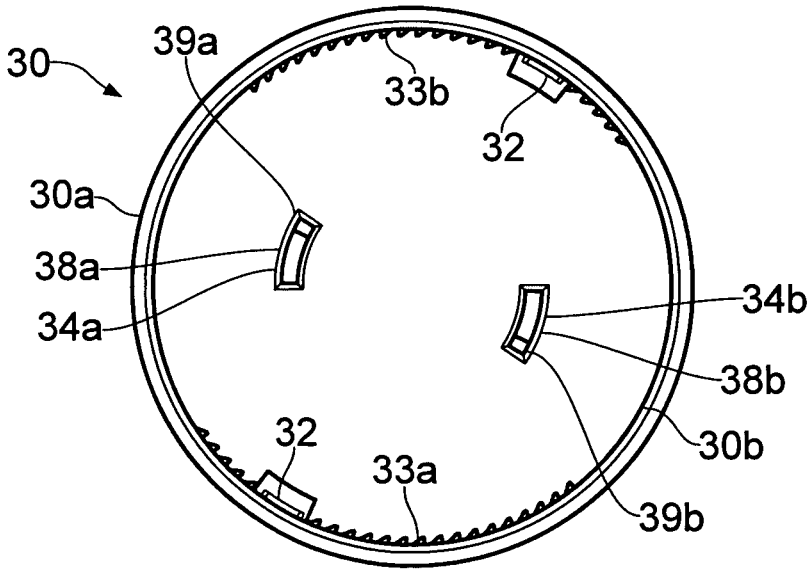
FIG. 6B is an under planned view of the outer part of FIG. 6A.

Referring now to FIGS. 6A and 6B the outer part 30 is shown in more detail.

The outer part 30 is generally cup-shape and comprises a cylindrical side wall 30*a* and a top plate 30*b*. The exterior of the outer part 30 comprises a plurality of knurls 30*c* which help to lock the shell part 37 and to prevent relative rotation.

The interior of the sidewall 30*a* comprises a circumferential bead 31 for preventing the outer part 30 being lifted off the inner part by engagement with the corresponding bead 25*c*. The interior of the sidewall 30*a* also comprises a pair of drive dogs 32 which engage in the ramps 26 of the inner part 25 and ride up them as the outer part 30 is rotated relative to the inner part 25.

The interior of the side wall 38 also comprises a pair of diametrically opposed ratchet arrangements 33*a*, 33*b* designed and positioned to run over and lock onto the corresponding ratchet arrangements 27*a*, 27*b* on the inner part 25 to prevent counter rotation.

Figure 7A:
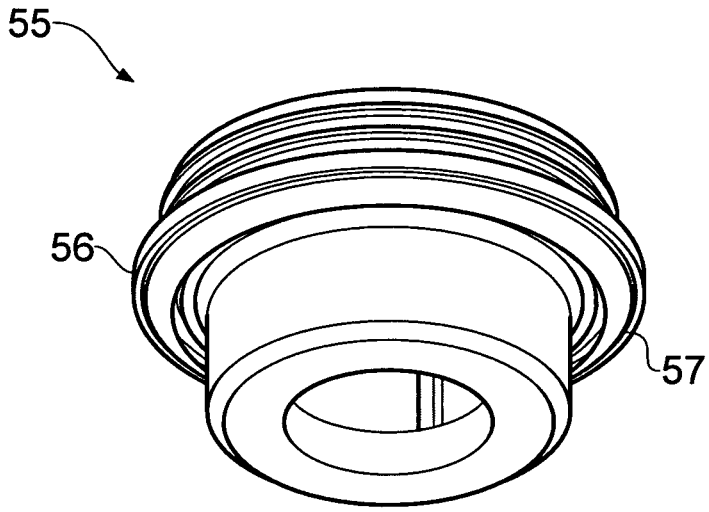
FIG. 7A is a perspective view of a valve housing forming part of the closure.
Figure 7B:
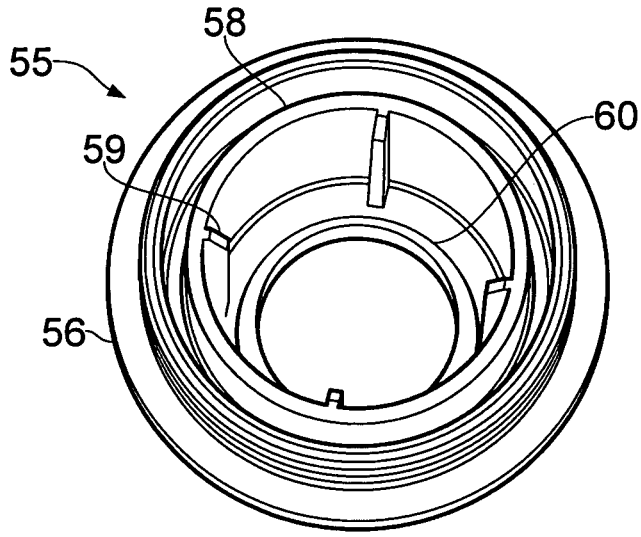
FIG. 7B is a further perspective view of the valve housing of FIG. 7A.

The underside of the top plate 30*b* includes a pair of drive dogs 34*a*, 34*b* each of which comprises a main body 38*a*, 38*b* and a locking tooth 39*a*, 39*b*. Referring now to FIGS. 7A and 7B a valve housing 55 is shown in more detail.

The housing 55 comprises a generally cylindrical body having a circumferential sealing flange 56 with a depending sealing lip 57 (sometimes referred to as a "crab's claw").

The exterior of the housing 55 includes two circumferential beads 61, 62 which are used to clip the housing into the body 20 (as shown in FIG. 1). The interior of the housing 55 comprises a valve chamber 58 having four locating ribs 59 and a valve seat 60.

Figure 8A:
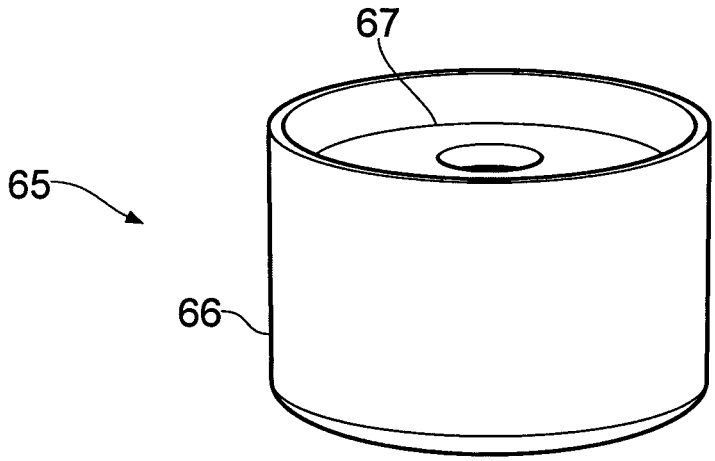
FIG. 8A is a perspective view of a valve member forming part of the closure.
Figure 8B:
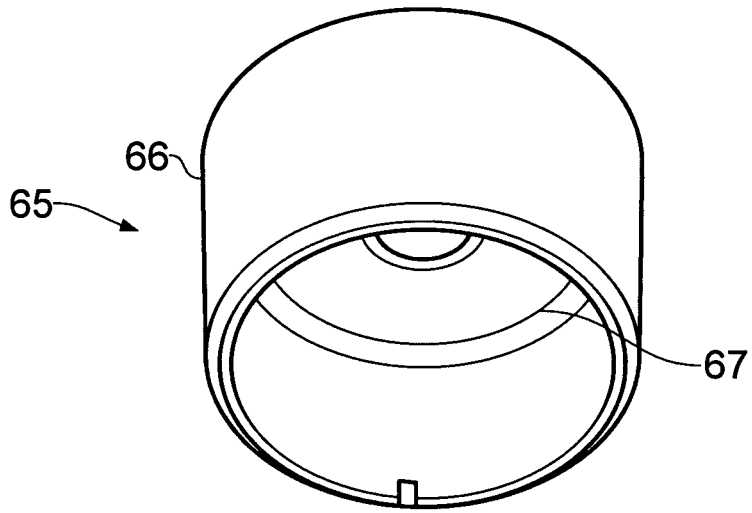
FIG. 8B is a further perspective view of the valve member of FIG. 8A.

Referring now to FIGS. 8A and 8B a float valve 65 is shown in more detail.

The valve 65 comprises a generally cup-shape body comprising a cylindrical side wall 66 and a recessed top plate 67.

The operation of the closure will now be described in more detail.

Initially, the body 20 is locked on to the neck 15 be the ribs 21*b* to prevent axial and rotational movement. The inner part 25 cannot rotate relative to the body 20 by virtue of the ratchets 23,25*b*. The shell part 37 cannot rotate relative to the outer part by virtue of the knurls 30*c*. The outer part 30 cannot be lifted off the inner part 25 by virtue of the locking beads 25*c*, 31 and by virtue of the drive dogs 32 engaging under the steps 26*a*

The shell part 37 is grasped by a user and turned. This causes the outer part 30 to rotate relative to the inner part 25. The drive dogs 32 in the outer part rise up the ramps 26 in the inner part and the drive dogs 34*a* rise up the ramps 28*a*, 29*a*. The ratchets 33*a* pass over the ratchets 27*a*, 27*b*.

The outer part is caused to rise by 2 mm. At this point continued rotation causes the locking teeth 39*a*, 39*b* to drop into the locking recesses 29*a*, 29*b*. In addition, the ratchets 33*a* have rotated beyond the ratchets 27*a*, 27*b*. The inner part drops back down by 0.5 mm.

Continued rotation of the outer part, relative to the inner part, is not possible because the drive dogs 32 abut against the end of the ramps 26; and, the drive dogs 34*a*, 34*b* abut against the end of the ramps 28*a*, 28*b*. In this second position the open end of the outer part 30 has moved axially away from the open end of the inner part 25 to expose the free end of the sidewall 25*a*.

Continued rotation of the cap part (the shell part 37, the outer part 30 and in the inner part 25) overcomes the torque required to allow the ratchets 25 to pass over the ratchets 23 which causes the inner part to rotate relative to the body. The internal screw threads 25*d* on the inner part rise up the external screw threads 22*a* of the body.

The cap part can now be lifted off the body 20 to allow the contents of the container to be dispensed. The contents are dispensed through the valve housing 55. The valve 65 lifts off the seat 60 as the container is upturned and contents flow out. The valve 65 re-seals against the seat 60 under the weight of the valve control ball 70 when the container is returned to an upright position. This prevents re-filling of the container.

When the cap part is returned, the inner part 25 is screwed back onto the body 20. The inner part screws back down to its original position, but the outer part cannot because it is locked in position both by the axial locking means provided by the drive dogs 34*a*, 34*b* and the lateral locking means provided by the ratchets 33*a*, 33*b* and 27*a*, 27*b*. This means that the gap G is formed between the shell parts 36, 37 with free end of the inner part skirt visible through it. This irreversible opening event provides visual evidence that the closure has been opened at least once. The gap G cannot be closed without destroying the closure.

Because the gap G between the metal shell parts 36, 37 is not generated by placing an obstruction directly between them, it is not possible to close the gap G by a simple cutting operation. The visible band in the gap formed by the inner part could be cut and the gap in the shell would remain.

By providing the dual axial and lateral ratchet arrangements, re-setting closure back to its original position to close the gap G by anti-rotation is made difficult. In an alternative embodiment (not shown), a similar closure is provided with just an axial ratchet arrangement.

Figure 10:
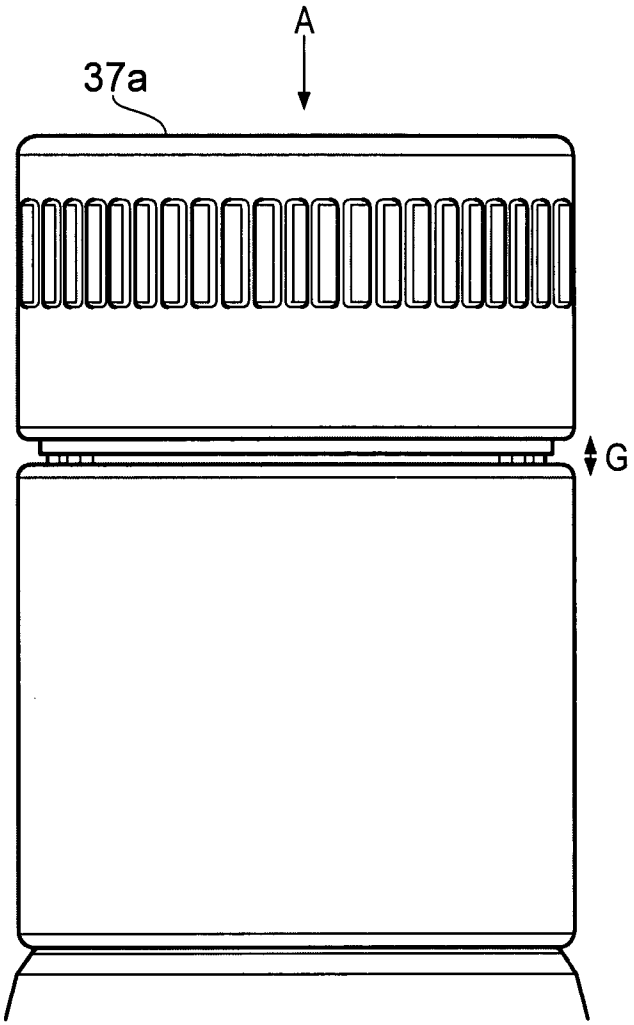
FIG. 10 is a side elevation of the closure of FIG. 9.
Figure 9:
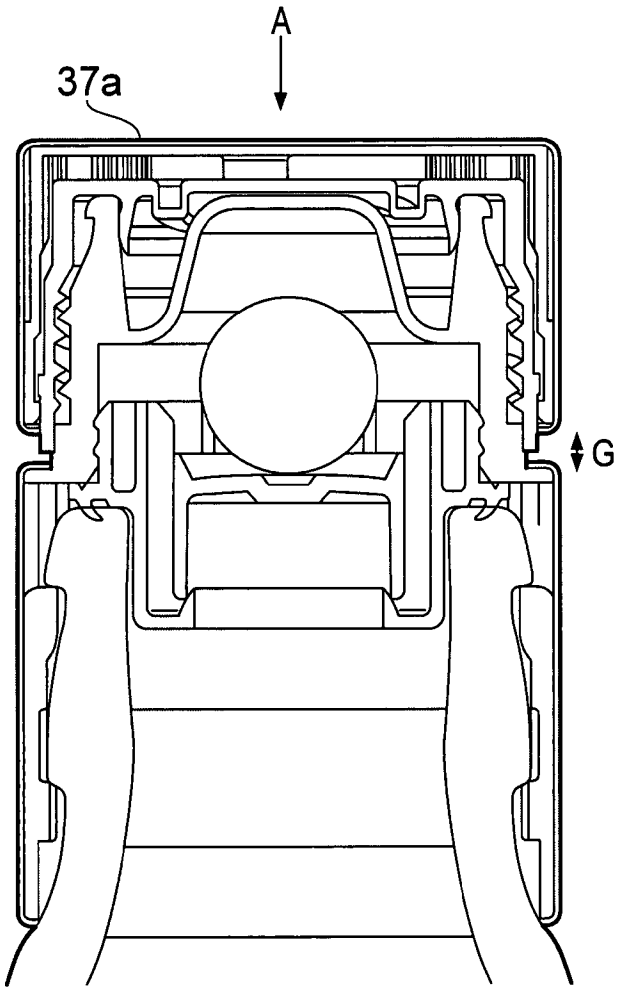
FIG. 9 is a section of the closure of FIG. 1 shown in a second position with a tamper-indicating gap.

Referring now to FIGS. 9 and 10 the closure 10 is shown in the second position with the gap G visible radially inwardly of and between the adjacent ends of the shell parts.

Figure 12:
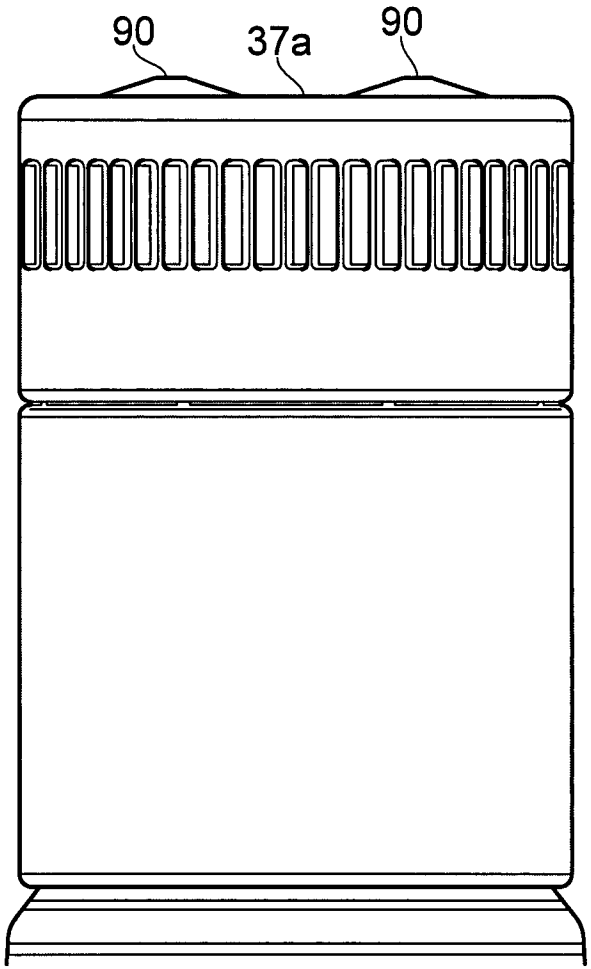
FIG. 12 is a side elevation of the closure of FIG. 11.
Figure 11:
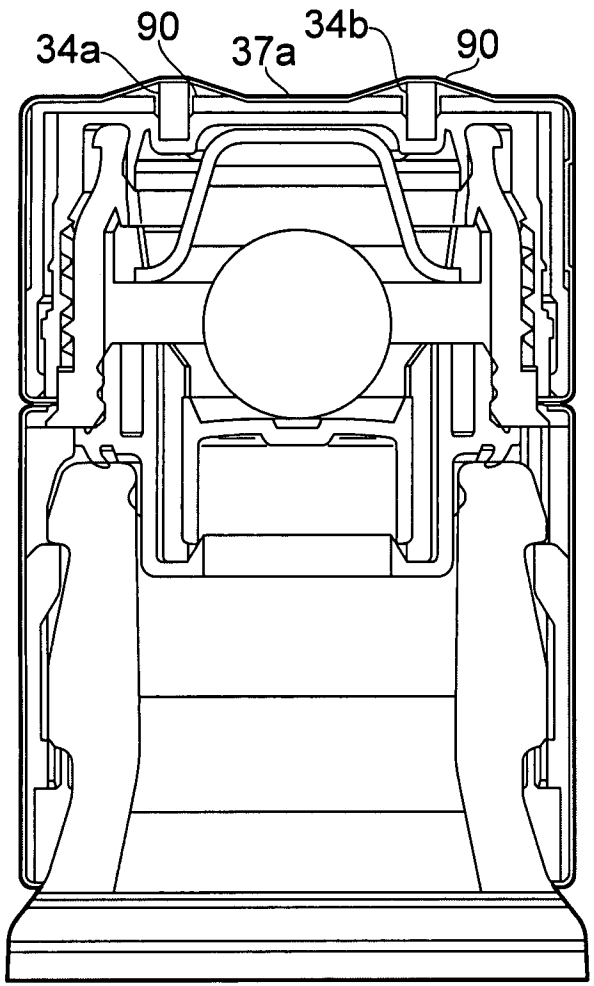
FIG. 11 is a section of the closure of FIG. 9 shown following the application of excessive axial force to close the gap.
Figure 13:
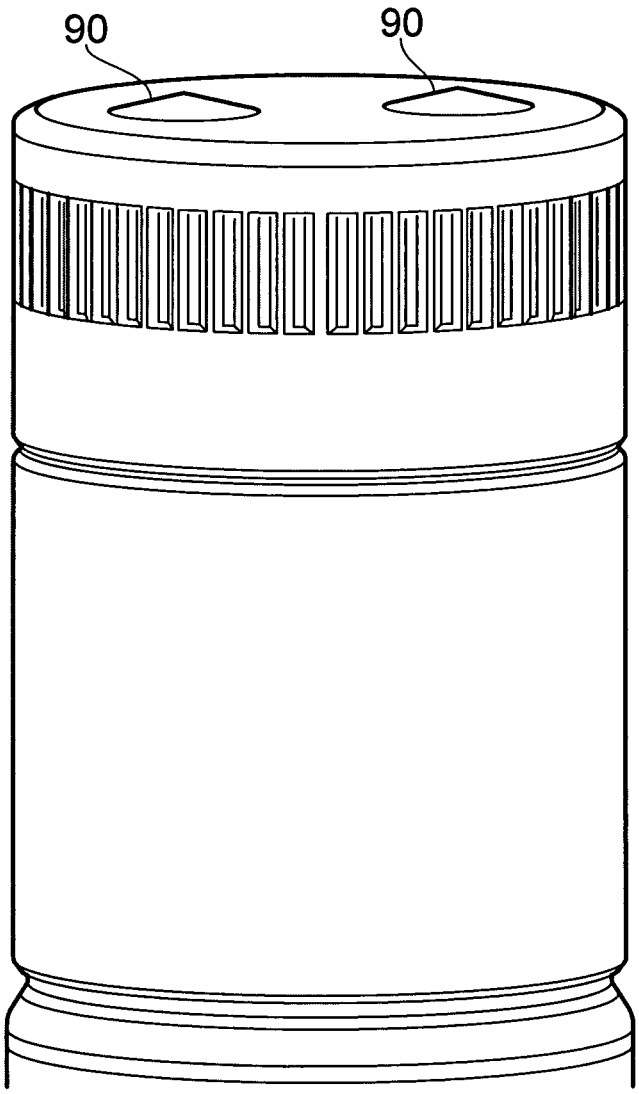
FIG. 13 is a perspective view of the closure of FIG. 12.

If axial force A is applied to the top of the closure, for example by upturning the container and driving the closure into the ground, the lateral ratchet mechanism is destroyed and the inner and outer parts return to the first position shown in FIG. 1. The gap G is closed. However, referring now also to FIGS. 11 to 13, the axial force causes the top plate 37*a* of the shell part 37 to be forced against the drive dogs 34*a*, 34*b*. This, in turn, causes flexing of the top plate and the dogs are pushed into the top plate to cause two raised formations 90. The top plate 37*a* may be locally weakened to facilitate deformation by the dogs.

Figure 14:
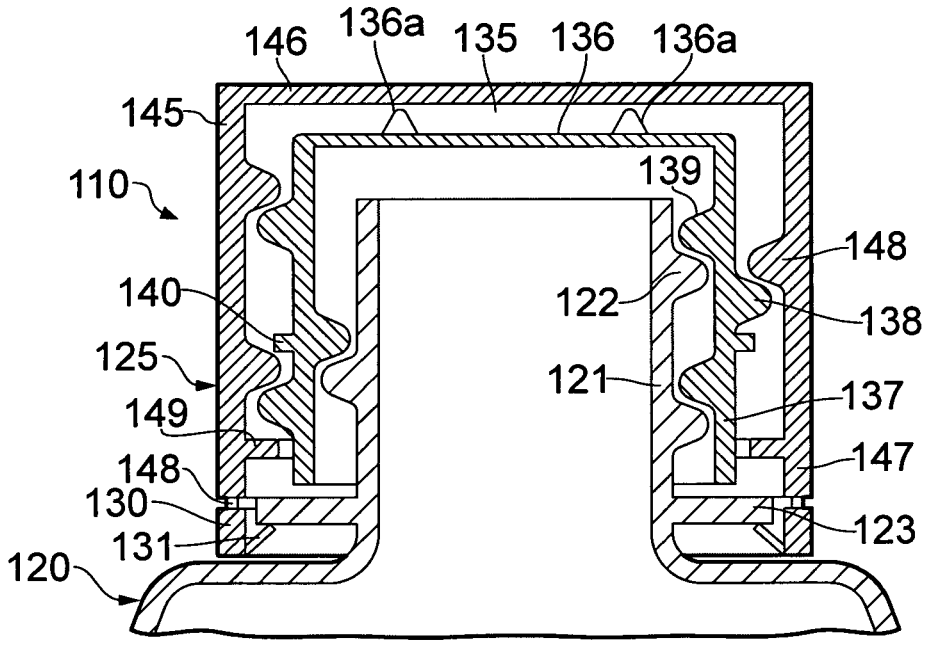
FIG. 14 is a section of a closure formed according to an alternative embodiment applied to a container neck.

Referring now to FIG. 14 there is shown a tamper-evident closure generally indicated 110 attached to a container generally indicated 120. The container 120 includes a neck portion 121 with external screw threads 122. At the lower end of the neck 121, is an annular retention ring 123, the purpose of which is described in more detail below.

The closure comprises a first portion 125 and a second portion 130. The first portion 125 includes inner 135 and outer 145 parts. The inner part 135 comprises a disk-shape top plate 136 with a cylindrical skirt 137 depending from its periphery. The outer surface of the skirt 137 has screw threads 138 for engaging corresponding threads on the outer part 145. The inner surface of the skirt 137 has screw threads 139 for engaging corresponding threads 122 on the container 120.

Figure 16:
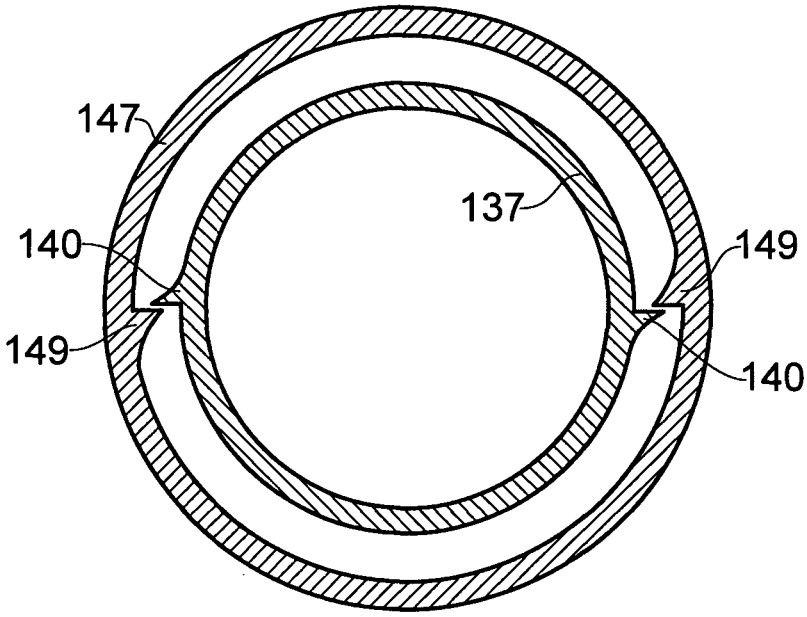
FIG. 16 is a section of the closure of FIG. 15 showing locking means which locks inner and outer parts together.

Approximately half way along its length, the outer surface of the skirt 137 also includes two diametrically opposed wedge-shape ratchet members 140 (best shown in FIG. 16).

The outer part 145 comprises a disk-shape top plate 146 with a cylindrical skirt 147 depending from its periphery. The inner surface of the skirt 147 has screw threads 148 for engaging the threads 138 on the inner part 135. At its open end, the inner surface of the skirt also includes two dimensionally opposed, wedge-shape ratchet members 149 (best shown in FIG. 16).

The second portion 130 comprises an annular tamper-evident band and is connected to the open end of the outer part skirt 147 by frangible bridges 148. At the other end of the second portion 130, a plurality of flaps 131 project radially inwardly and upwardly. The flaps 131 are positioned to engage beneath the annular retention ring 123 on the container 120.

The top plate 136 has two barbs 136*a* which project toward the top plate 146. The purpose of the barbs will be described in more detail below.

The operation of the closure will now be described with reference to FIGS. 14 to 19.

In order to open the closure 110, the outer part 145 is grasped and turned. The tightness of fit between the inner part 135 and the neck portion 121 is designed to be greater than that between the inner part 135 and the outer part 145, which means that there is greater friction. Accordingly, when the outer part 145 is initially turned it is the outer part 145 which moves axially upwards relative to the inner part 135; the inner part remains stationery.

As the outer part 145 moves upwards the flaps 131 prevent the second portion 130 from moving by virtue of their engagement under the retention ring 123. As a result, the frangible bridges 148 break and the second portion 130 remains in position. Continued turning of the outer part 145 eventually leads to the ratchet members 140, 149 passing each other and locking in the position shown in FIGS. 15 and 16. The outer and inner parts 145, 135 are now irreversibly locked in this second position. It will be seen that there now exists a gap (G) between the open end of the outer part skirt 147 and the second portion 130. The gap (G) is empty and unobstructed; that is, the gap (G) is not created by an obstruction structure which braces between the skirt 147 and the second portion 130.

Figure 15:
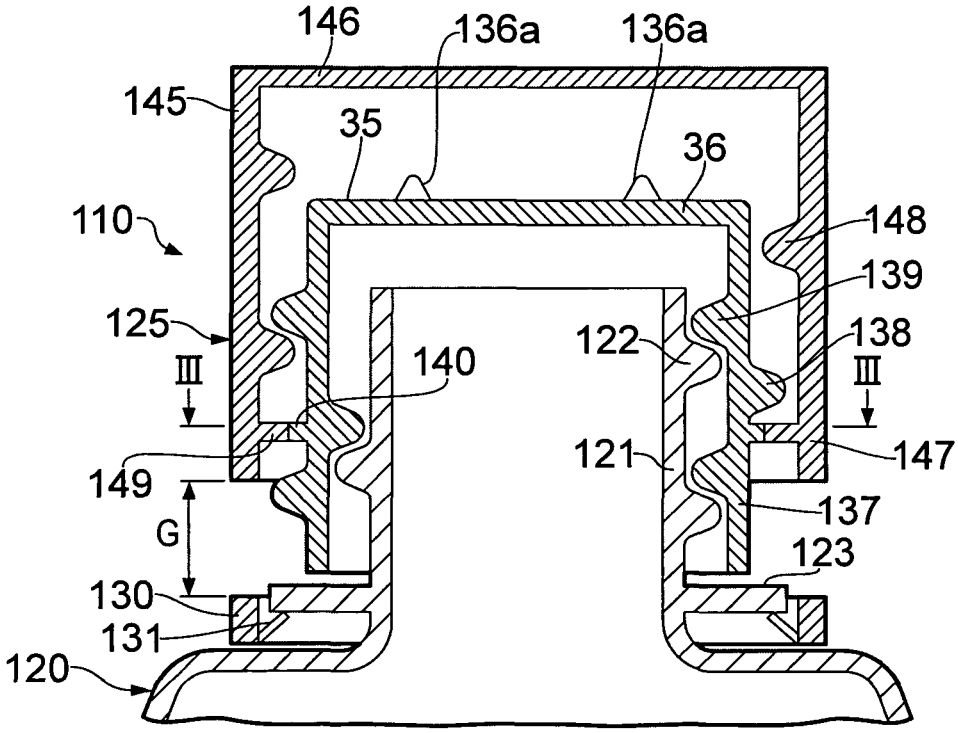
FIG. 15 is a section of the closure of FIG. 14 shown in a second position in which a gap is generated.
Figure 17:
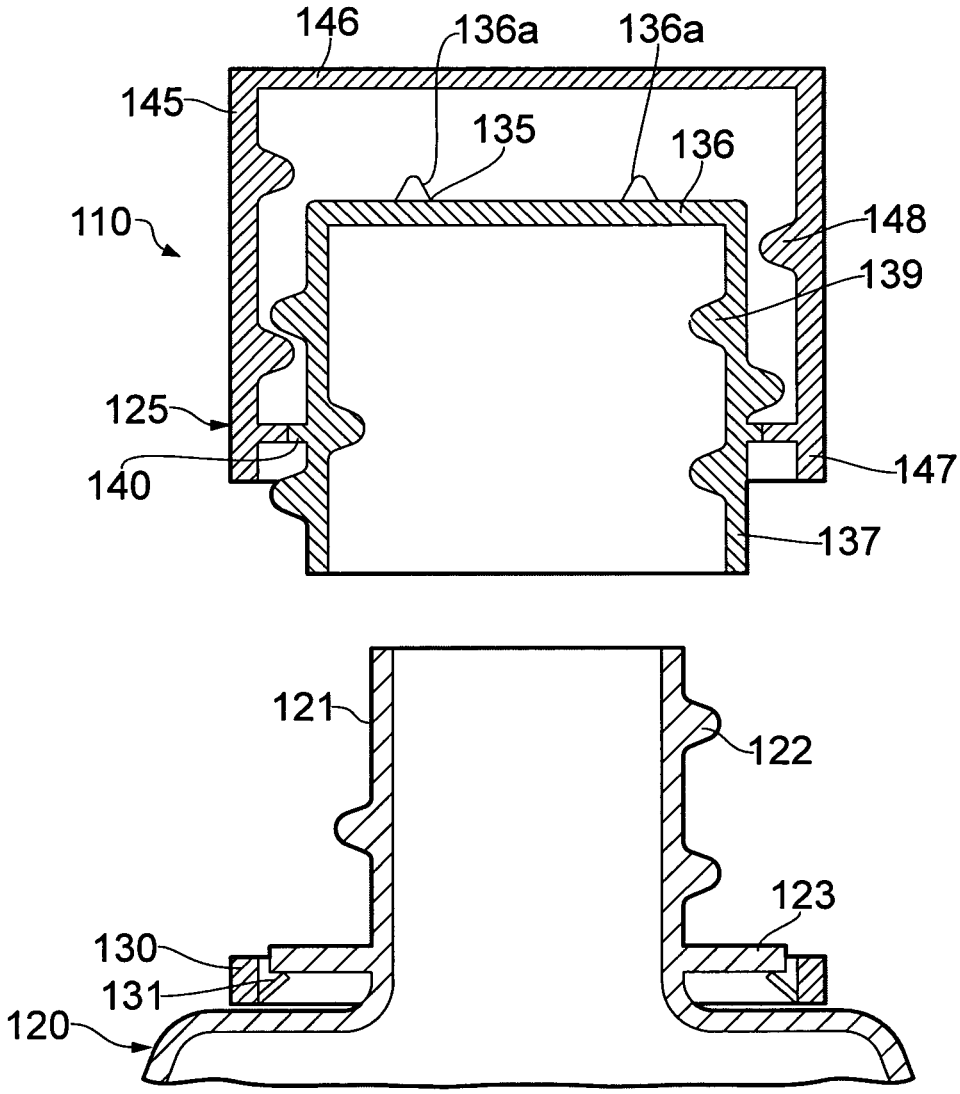
FIG. 17 is a section of the closure of FIG. 15 shown with a cap part removed from the container neck.
Figure 18:
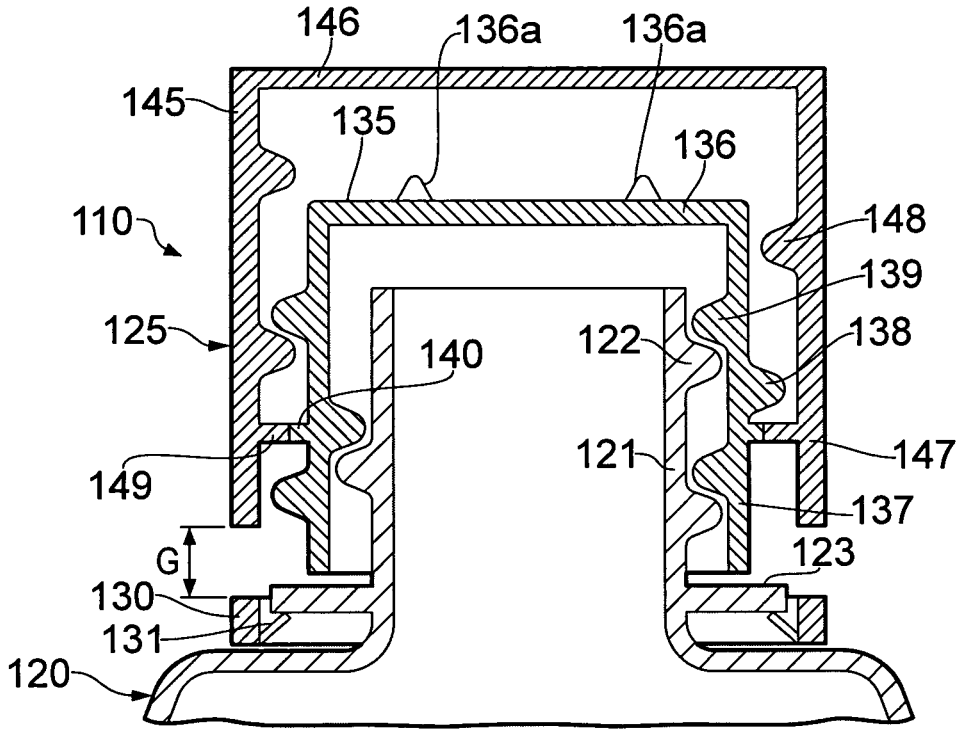
FIG. 18 is a section of the closure of FIG. 17 shown with the cap replaced and the gap intact.

With the outer 145 and inner 135 parts locked together as shown in FIG. 15, continued turning of the outer part 145 now acts to unscrew the inner part 135 from the container neck 121. In FIG. 17, the closure 110 is shown removed completely from the container neck 121 to allow access to the container 120.

When the closure 110 is replaced on the container neck 121 it cannot be returned to its first position because the inner and outer parts 135, 145 are still locked together. Instead the closure can only be returned to the position shown in FIG. 18, in which the gap (G) remains.

In this embodiment it will be noted that the length of the inner part skirt 137 is such that it protrudes below the level of the outer part skirt 147 in the second position. As a result, the skirt 137 can be seen through the gap (G). The skirt 137 could, for example, be brightly colored or include a message in the area visible through the gap (G) to accentuate the fact that the gap (G) is there and warn of potential tampering.

Figure 19:
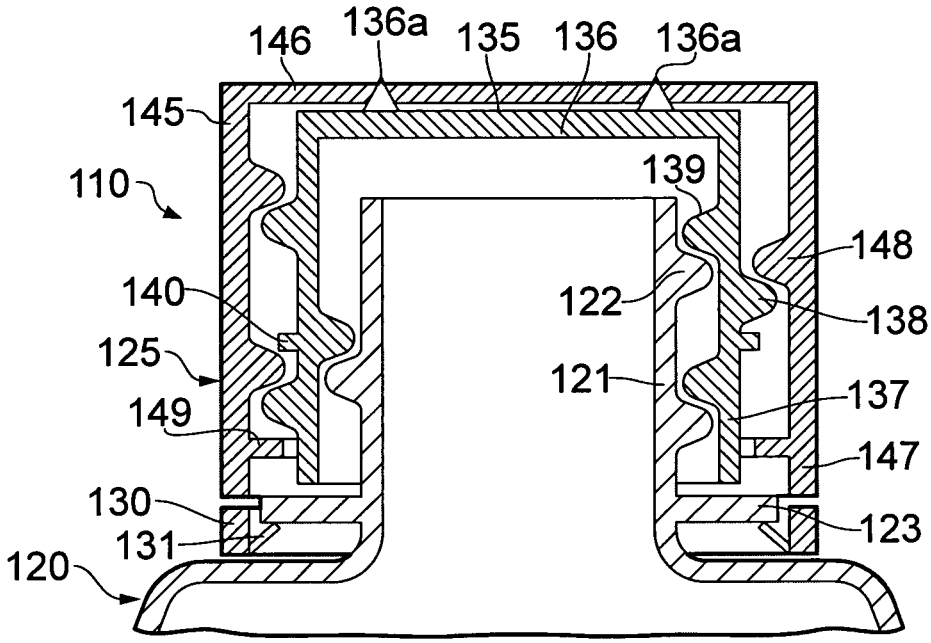
FIG. 19 is a section of the closure of FIG. 18 shown following the application of axial force on the cap to close the gap.

If significant axial force is applied to the closure against the top plate 146, the outer part 145 is forced back down over the inner part 135. The top plate 146 is forced towards the top plate 136 and the barbs 136*a* are caused to puncture the top plate 146 as shown in FIG. 19.

The barbs 136*a* may be brightly colored or colored to contrast with the top plate 146 so as to be highly visible.

The benefit of puncturing the plastic top plate 146 is that, even if the upper part 145 could be moved back up relative to the inner part 135, the puncture holes would still remain in the top plate 146.

Figure 21:
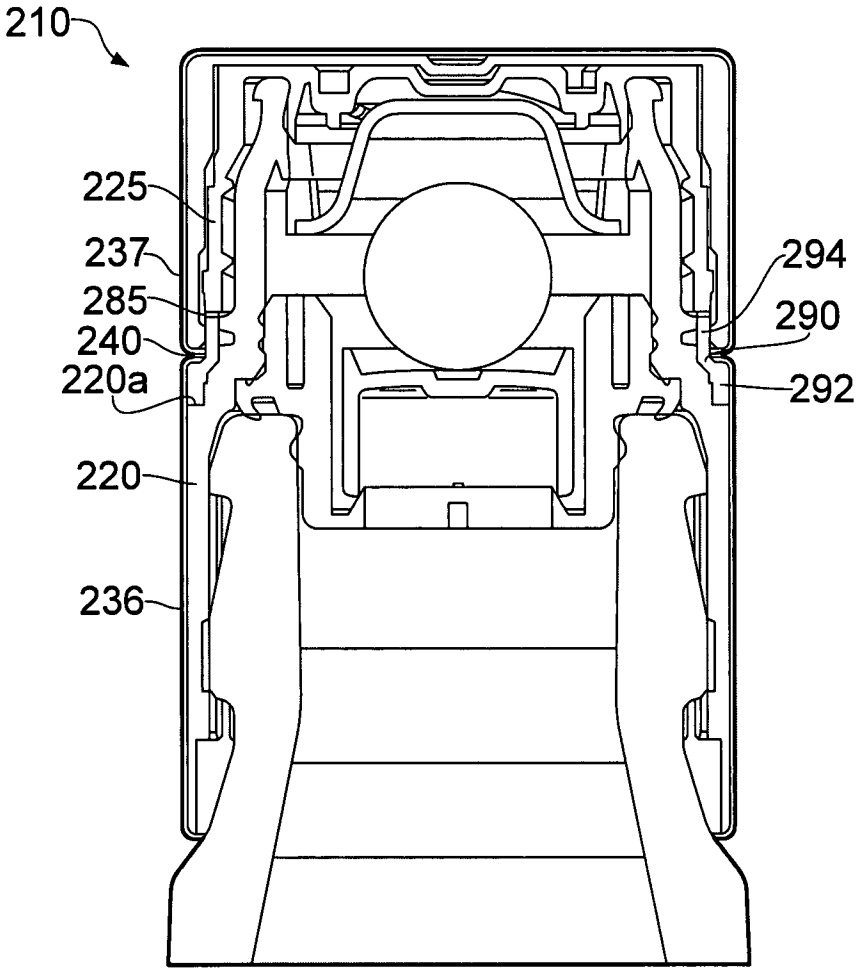
FIG. 21 is a section of the closure shown in FIG. 20.
Figure 20:
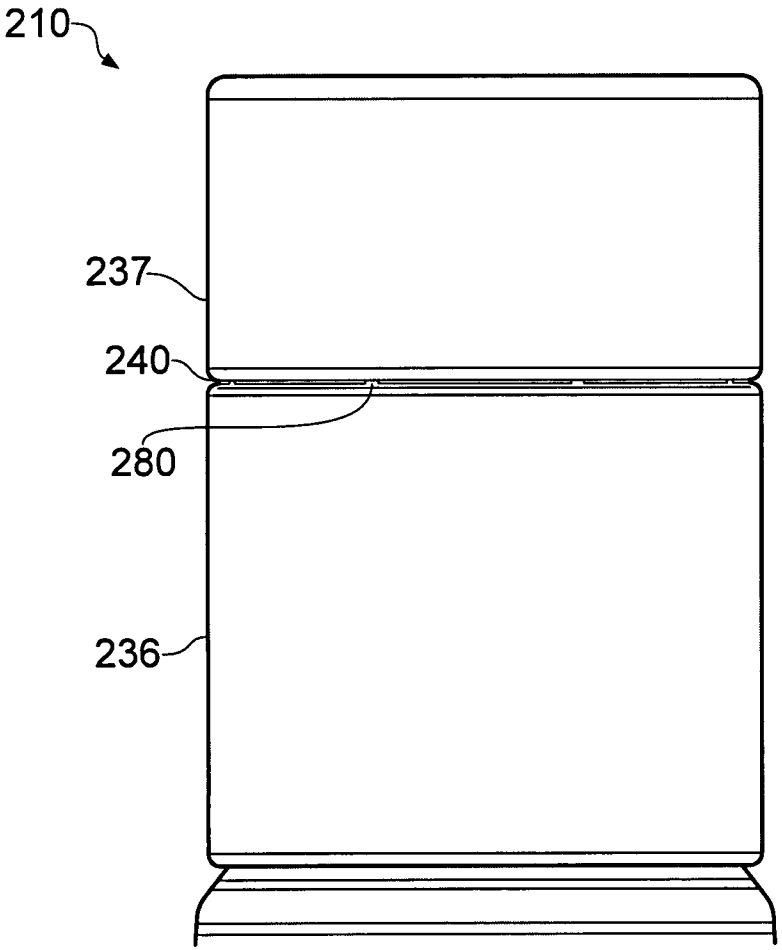
FIG. 20 is a side elevation of a closure formed according to an alternative embodiment.

Referring now to FIGS. 20 and 21 there is shown a closure 210 formed according to an alternative embodiment. The closure 210 is similar to the closures illustrated in FIGS. 1 to 19.

In this embodiment, the upper and lower shell parts 236, 237 are initially joined by a plurality of frangible bridges 280 which will break if either: (i) the lower shell part 236 is rotated before initial opening; or, (ii) an attempt is made to pull the top part of the closure off without unscrewing. The bridges therefore serve as an additional tamper-evident feature.

As seen best in FIG. 21, the inner part 225 of the closure extends beyond the split line 240 and the open end of the outer part to provide a dog-leg shape terminal portion 290 which rests on a shoulder 220*a* on the main body 220 so that one half 292 of the terminal portion fits beneath the upper end of the lower shell part 236 and the other half 294 fits in the upper shell part 237. Above the shell split line 240, a plurality of frangible bridges (not shown) are formed in the inner part 225 to form a split line 285.

Figures 22, 23, 24, 25:
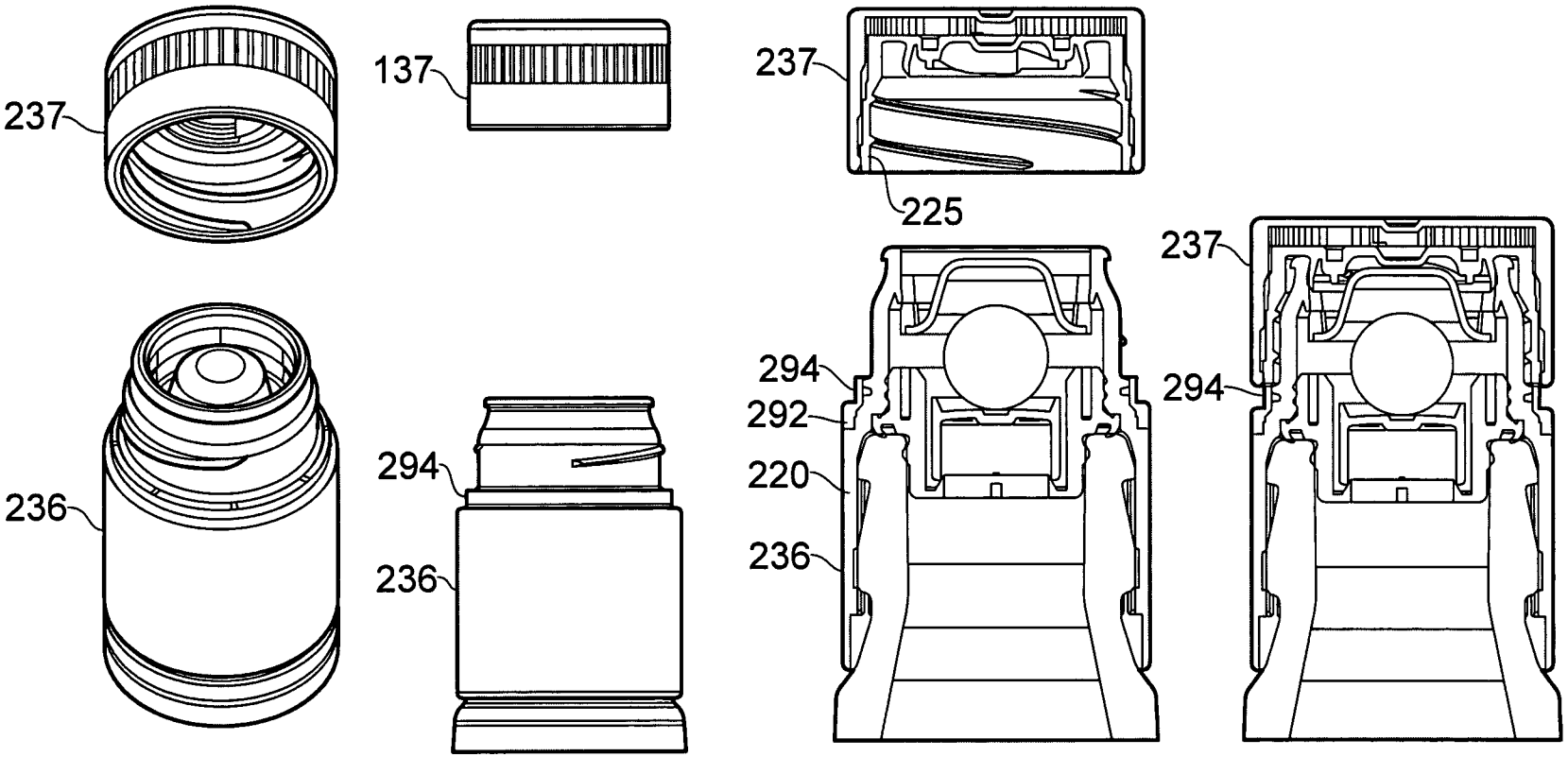
FIG. 22 is a perspective view of the closure of FIGS. 20 and 21 shown in an open position.
FIG. 23 is a side elevation of the closure of FIG. 22.
FIG. 24 is a section of the closure shown in FIG. 23.
FIG. 25 is a section of the closure shown in FIGS. 20 to 24 shown in a closed position following an initial irreversible opening event.
Figure 29:
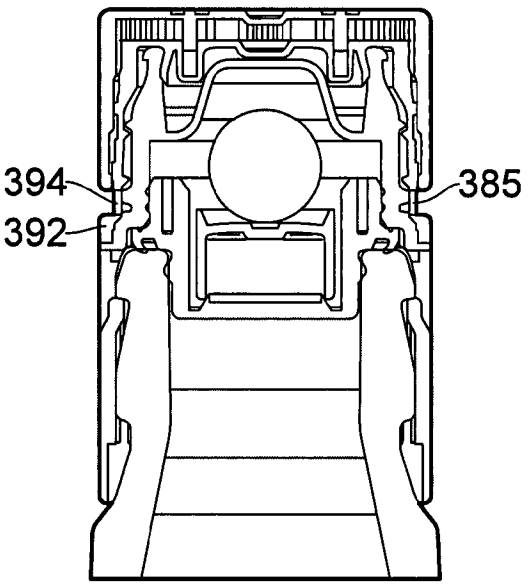
FIG. 29 is a section of the closure shown in FIGS. 26 to 28 shown in a closed position following an initial irreversible opening event.
Figure 28:
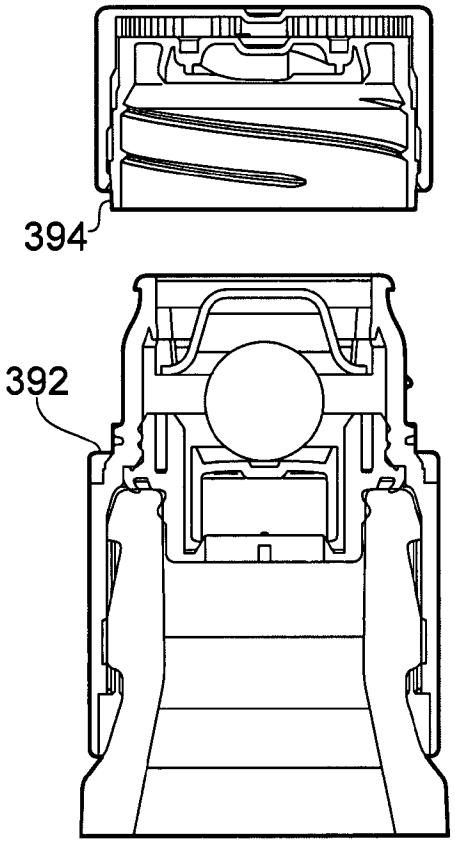
FIG. 28 is a section of the closure shown in FIGS. 26 and 27.
Figure 27:
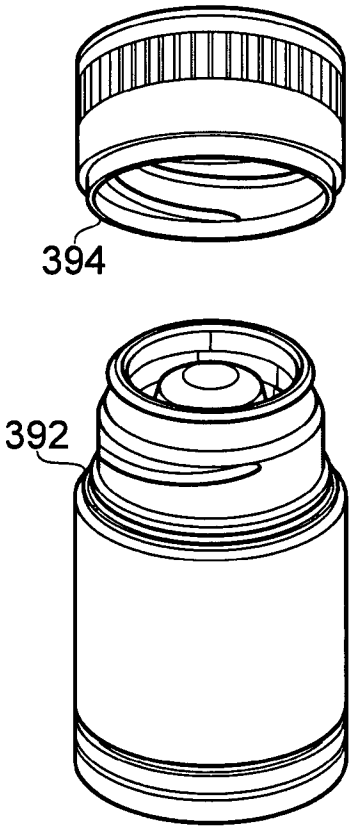
FIG. 27 is a perspective view of the closure shown in FIG. 26.
Figure 26:
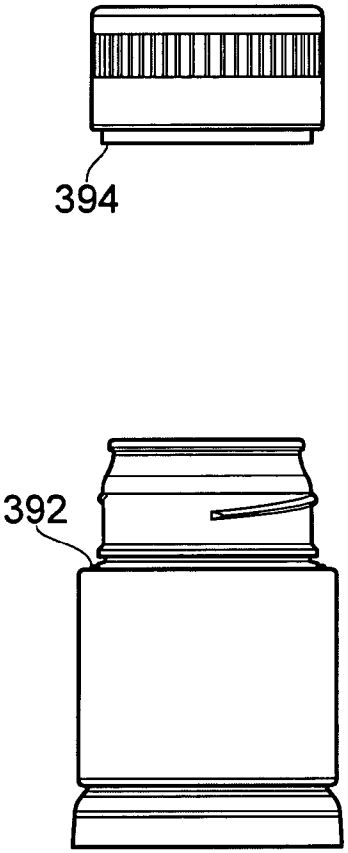
FIG. 26 is a side elevation of a closure formed according to an alternative embodiment and shown in an open position.

Referring now to FIGS. 22 to 24, in use, when the closure 210 is opened, the shell part 237 is unscrewed in the same way as that described in relation to FIGS. 1 to 13 for the closure 10. In this embodiment, however, the unscrewing action breaks both the bridges 280 on the split line 240 and those on the split line 285. The result is that the terminal portion 290 of the inner part remains held on the body so that the half 294 produces a visible upstanding band. When the top cap is replaced, as shown in FIG. 25, the band is visible through the gap G.

FIGS. 26 to 32 show a closure 310 formed according to an alternative embodiment. The closure 310 is very similar to the closure 210 and includes and extended inner part 325 which has a dog-leg shape terminal portion 390. In this embodiment a split line 385 is formed approximately in line with the split line 340 between the shell parts. The result is that in use instead of a band being retained on the lower part of the closure, the upper half 394 of the terminal portion 390 is removed with the top cap on first opening and projects below the open end of the cap so as to be clearly visible. When the closure is then returned to the closure position (FIG. 29) the portion half 394 is visible in the gap G.

Figure 32:
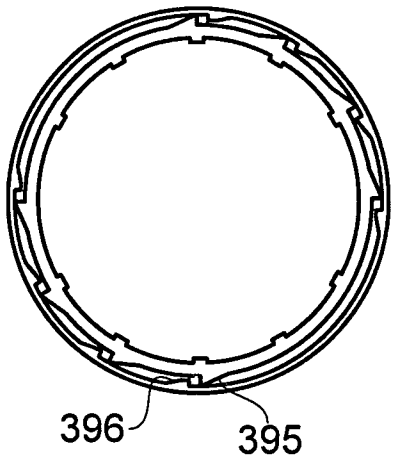
FIG. 32 is a plan view of the closure body/end portion shown in FIG. 30.
Figure 31:
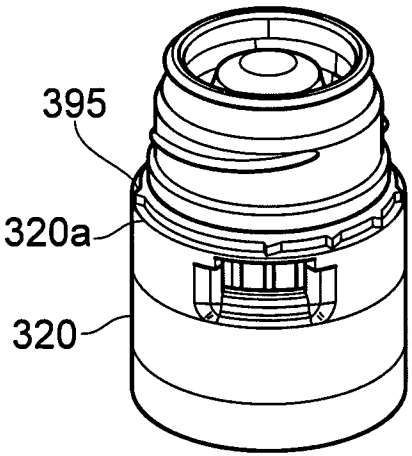
FIG. 31 is a perspective view of the closure body shown in FIG. 30.
Figure 30:
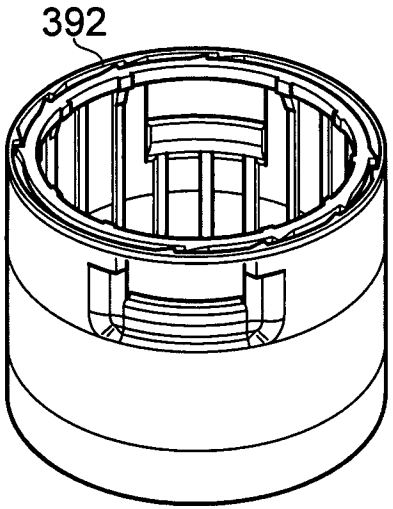
FIG. 30 is a perspective view of part of a closure body forming part of the closure shown in FIGS. 26 to 29 illustrating connection of an inner part terminal end portion.

As shown best in FIGS. 30 to 32, the terminal portion half 392 sits on the body shoulder 320*a*. The body wall extending from the shoulder 320*a* carries a plurality of ratchet teeth 395 for engaging a plurality of corresponding teeth 396 formed on the interior surface of the half 392. This prevents the half rotating relative to the body 320 in use and ensures breakage of the bridges formed along the split line 385. A similar arrangement is provided for the closure 210.

Both closures 210, 310 include means for indicating if the tamper-evidence provided by the gap G has been overridden.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A tamper evident closure for a container, said tamper evident closure comprising:

(a) a first portion, said first portion further comprising:
  (i) an inner part;
  (ii) an outer part; and (b) a second portion, wherein said first portion and said second portion are provided in a shell, said shell further comprising:
  (i) a first shell part; and
  (ii) a second shell part, wherein said outer part is movable relative to said inner part from a first position, in which said first shell part and said second shell part are adjacent each other, to a second position in which there is a gap therebetween;

(c) locking means for locking said tamper evident closure in said second position upon first opening so that said gap cannot easily be closed; and (d) indicator means arranged such that if said locking means is overridden to close said gap, said indicator means provides a visual identification on said shell that said gap has been closed.

2. A tamper evident closure as claimed in claim 1, wherein said indicator means are adapted to mark said shell to indicate closing of said gap.

3. A tamper evident closure as claimed in claim 1, wherein said indicator means are adapted to produce one or more markings on the surface of said tamper evident closure to indicate closing of said gap.

4. A tamper evident closure as claimed in claim 3, wherein said one or more markings comprise one or more raised formations formed on the shell if the gap is closed.

5. A tamper evident closure as claimed in claim 1, wherein said shell is deformed to indicate closing of said gap.

6. A tamper evident closure as claimed in claim 5, wherein said shell is locally weakened to facilitate said deformation.

7. A tamper evident closure as claimed in claim 1, wherein said indicator means are adapted to puncture the surface of said shell to indicate closing of said gap.

8. A tamper evident closure as claimed in claim 1, wherein said indicator means also forms part of said locking means.

9. A tamper evident closure as claimed in claim 1, wherein said locking means is adapted to prevent relative rotation between said inner part and said outer part.

10. A tamper evident closure as claimed in claim 1, wherein said shell has a top plate and a visual indication is provided on said shell top plate.

11. A tamper evident closure as claimed in claim 1, wherein said outer part includes a top plate and part of said locking means is carried on or by said top plate.

12. A tamper evident closure as claimed in claim 1, wherein said inner part further comprises a top plate and part of said locking means is proximate said top plate.

13. A tamper evident closure as claimed in claim 1, wherein said locking means further comprises a longitudinal ratchet arrangement.

14. A tamper evident closure as claimed in claim 1, wherein said second shell part is adapted to remain a container and the first part comprises a removable cap.

15. A tamper evident closure as claimed in claim 1, wherein said closure further comprises an in-bore fitment.

16. A tamper evident closure as claimed in claim 1, wherein said first portion is adapted to engage an in-bore fitment associated with said container.

17. A tamper evident closure as claimed in claim 1, wherein said gap is unobstructed.

18. A tamper evident closure as claimed in claim 1, wherein said inner part further comprises a part which extends beyond said outer part towards said second portion in said second position, said part being positioned so as to be visible through said gap.

19. A tamper evident closure as claimed in claim 1, wherein said indicator means are adapted to activate following axial overriding of said locking means to close said gap.

20. A tamper evident closure for a container, said tamper evident closure comprising:

(a) a first portion, said first portion further comprising;
  (i) an inner part;
  (ii) an outer part; and (b) a second portion, wherein said outer part is movable relative to said inner part from a first position in which at least part of said first and said second portions are adjacent each other to a second position in which there is a gap therebetween;

(c) locking means for locking said tamper evident closure in said second position upon first opening so that said gap cannot easily be closed;

(d) a shell; and (e) indicator means arranged such that if said locking means is overridden to close said gap, said indicator means provides a visual identification on said shell that said gap has been closed.

21. A tamper-evident closure for a container, said tamper evident closure comprising:

(a) a first portion, said first portion further comprising;
  (i) an inner part;
  (ii) an outer part relative to said inner part in a first position;
  (iii) a lateral ratchet arrangement for locking said inner and said outer parts in a second position; and
  (iv) a set of engagement formations and wherein said ratchet arrangement is located above said engagement formations;

(b) a second portion, wherein said outer part is movable relative to said inner part from said first position, in which at least part of said first and said second portions are adjacent each other, to said second position in which there is a gap therebetween;

(c) locking means for locking said tamper evident closure in said second position upon first opening so that said gap cannot easily be closed; and (d) indicator means arranged such that if said locking means is overridden to close said gap, said indicator means provides a visual identification on said shell that said gap has been closed.

* * * * *